United States Patent [19]

Frank et al.

[11] 4,029,924

[45] June 14, 1977

[54] CONTACT BLOCK INTERLOCK FOR ELECTRIC SWITCH

[75] Inventors: Stanley L. Frank; Stephen S. Dobrosielski, both of Beaver, Pa.

[73] Assignee: Westinghouse Electric Corporation, Pittsburgh, Pa.

[22] Filed: Sept. 16, 1975

[21] Appl. No.: 613,839

Related U.S. Application Data

[63] Continuation-in-part of Ser. No. 515,944, Oct. 10, 1974, abandoned.

[52] U.S. Cl. ..... 200/307; 200/16 A; 200/290; 200/340

[51] Int. Cl.² ..... H01H 13/00

[58] Field of Search ..... 248/27 R; 200/5 B, 16 C, 200/16 A, 76, 18, 159 R, 153 R, 153 J, 243, 250, 296, 301, 307, 290, 340

[56] References Cited

UNITED STATES PATENTS

| | | | |
|---|---|---|---|
| 3,231,706 | 1/1966 | Waldorf | 200/307 |
| 3,290,456 | 12/1966 | Meyer | 200/307 |
| 3,539,749 | 11/1970 | MacPheat | 200/159 R |
| 3,745,288 | 7/1973 | Reimer | 200/16 A |

FOREIGN PATENTS OR APPLICATIONS

| | | | |
|---|---|---|---|
| 1,615,888 | 8/1970 | Germany | 200/307 |

*Primary Examiner*—Gerald P. Tolin
*Attorney, Agent, or Firm*—L. P. Johns

[57] ABSTRACT

An electric switch characterized by at least two contact blocks stacked in end-to-end surface abutment, which blocks comprise movable contacts and means for moving the same, and interlock means interconnecting adjacent blocks against longitudinal separation.

1 Claim, 2 Drawing Figures

CONTACT BLOCK INTERLOCK FOR ELECTRIC SWITCH

This is a continuation-in-part of application Ser. No. 515,944, filed Oct. 10, 1974, now abandoned.

BACKGROUND OF THE INVENTION

1. Field of the Invention

This invention relates to electrical switching devices and, more particularly to interlock means for preventing separation of stacked switch blocks.

2. Description of the Prior Art

Electric switches are frequently provided with separable contact blocks and switch operator. The contact blocks are mounted within an enclosure and a switch operator is mounted for manual access on the enclosure cover and cooperates with the contact blocks when the blocks are in the closed position. One type of switch operator is the push-button type which actuates a series of stacked contact blocks which are secured together by snap interlocks which retain the contact blocks from separating.

It has been found, however, that although the stacked switches are secured together against longitudinal separation they frequently require additional interlock means to prevent their separation by lateral or twisting motion.

Associated with the foregoing is a problem of maintaining the movable contacts in the contact block within the normal or spring-biased position when the electric switch is subjected to abnormally high vibrations or shock. For example, switches used on board naval vessels requre that electric circuits be undisturbed during shell fire. The shock of shell fire causes considerable impact and vibration on the switches. Under some circumstances where the switches are in the open position it is desirable to maintain certain ancillary circuits in the open or closed position without interference from shocks incurred by shell fire.

SUMMARY OF THE INVENTION

Generally, in accordance with this invention it has been found that the foregoing problems may be satisfied by providing an electric switch comprising at least two contact blocks stacked in end-to-end surface abutment, each contact block having stationary and movable contacts, each block also having movable contact operating means including a guided reciprocable plunger, the plunger in each block being in end-to-end abutment with the plunger of an adjacent block, manual means adjacent to one block and operatively connected to the plunger thereof, and interlock means interconnecting adjacent blocks against separation.

The advantage of the device of this invention is that it maintains a series of contact blocks for an electric switch intact notwithstanding heavy vibrations occurring from external sources.

DESCRIPTION OF THE PREFERRED EMBODIMENT

Figure 1:
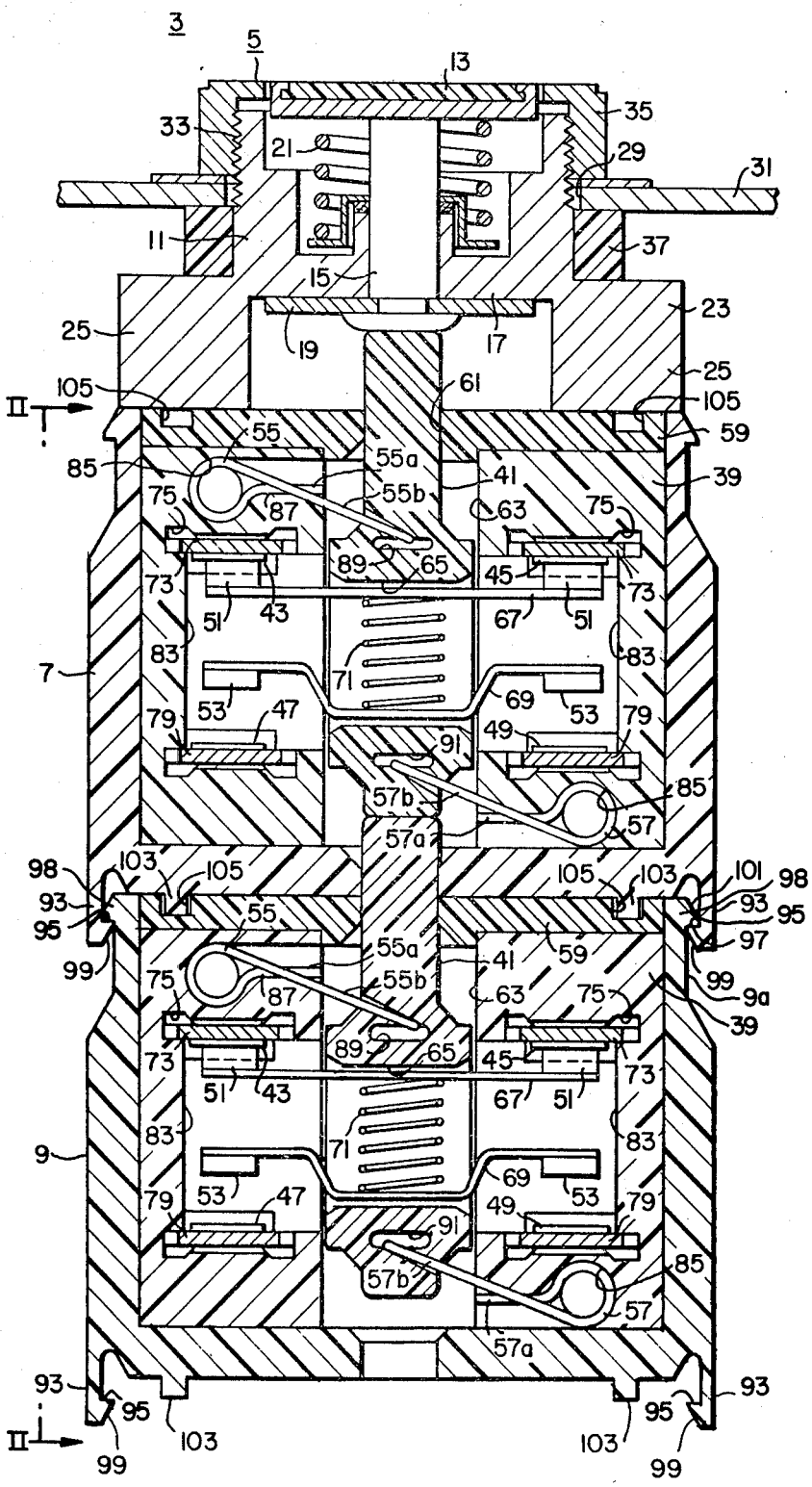
FIG. 1 is a vertical sectional view through an electric switch having a push-button operator and two stacked contact blocks.

In FIG. 1 an electric switch is generally indicated at 3 and it comprises a push-button operator 5 and a plurality, such as two, contact blocks or switches 7 and 9. The push-button operator 5 includes a sleeve type housing 11 as well as a plunger-type actuator or push-button 13 which is movably mounted within the housing. The actuator 13 includes a shaft 15 which extends through a web portion 17 and is secured in place by an operating washer 19. A return spring 21 is disposed between the actuator 13 and the web 17. The housing 11 includes a base 23 which includes an out-turned flange 25 which is mounted on the uppermost contact block 7 by suitable means such as bolts (not shown).

In addition, the outturned flange 25 also enables mounting the switch 3 in an opening 29 of a panel 31. The outer end portion of the housing 11, which extends through the opening 29 is threaded externally at 33 and a mounting ring 35 is provided thereon. To clamp the panel 31 between the ring 35 and the flange 25 with a gasket 37 disposed between the flange and the panel.

The contact blocks 7 and 9, being of similar construction, are provided with the same reference numbers for similar parts. Each contact block 7 and 9 comprises a housing 39, contact operating means or plunger 41, a pair of upper stationary contacts 43 and 45, a pair of lower stationary contacts 47 and 49, pairs of movable contacts 51 and 53, and means for biasing the plunger in a desired position which means comprise a pair of torsion springs 55 and 57. The housing 39 comprises a cover 59 which has a central opening 61 which communicates with a bore 63 in the housing. The plunger 41 is disposed in the opening 61 and the bore and is movable therein in response to movement of the pushbutton 13. The central portion of the plunger 41 includes a window 65 in which a pair of bridging contact carriers 67, 69 extend. A coil spring 71 is disposed between the intermediate portions of the carriers 67, 69 for retaining them in place within the window 65.

Figure 2:
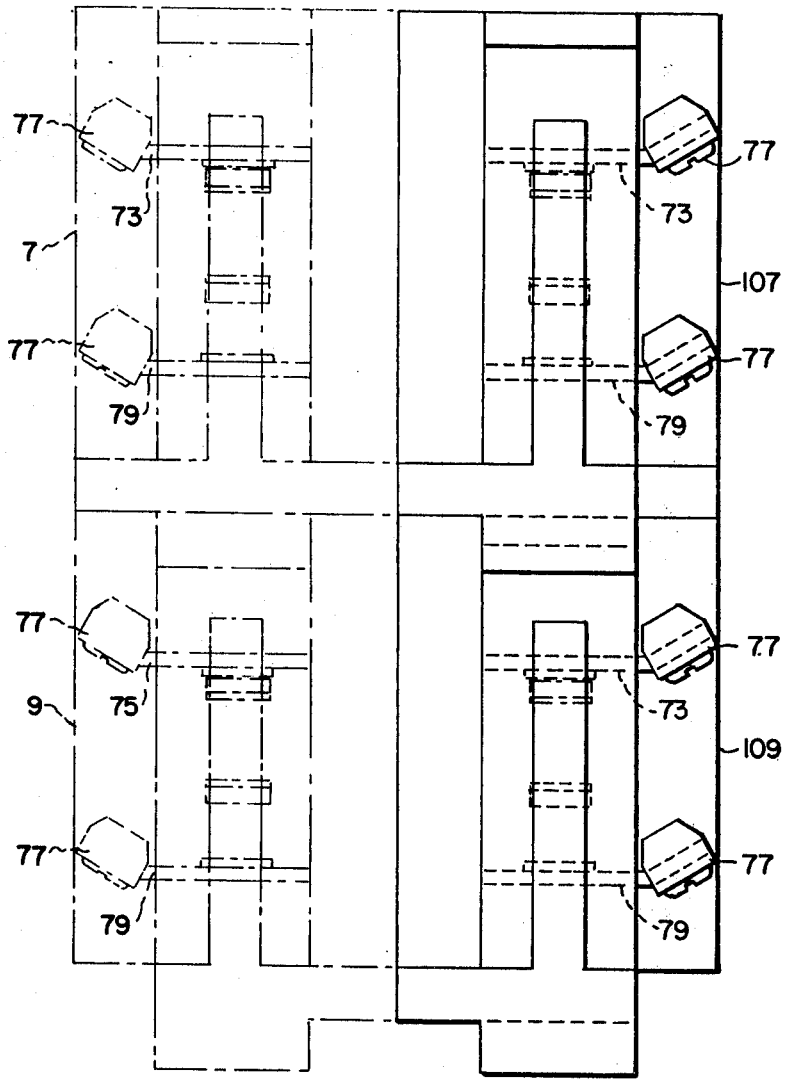
FIG. 2 is an elevational view taken on the line II—II of FIG. 1.

As shown in FIG. 1 the movable contacts 51, 53 are mounted on the carriers 67, 69, respectively. The stationary contacts 43, 45 which are engaged by the contacts 51, are mounted on similar conductors 73 which extend through apertures 75 in the housing and are provided with terminals 77 on opposite sides of the housing as shown in FIG. 2. Likewise, the contacts 47, 49 are mounted on similar conductors 79 which extend through the housing and are provided with external terminals 81. The movable contacts 51, 53, are disposed in similar chambers 83 within the housing.

The plunger 41 is normally retained in an uppermost position with contacts 51 engaging contacts 43 and 45 when the push-button 13 is released, by biasing means, such as the helical springs 55, 57, which are disposed in similar retaining holes 85 in the housing 39. The spring 55 includes end portions 55a and 55b, the former of which is biased against a surface 87 and the latter of which extends through a slot 89 in the plunger 41. The spring 57 includes end portions 57*a* and 57*b* which are disposed in a manner similar to that described for the spring portions 55*a* and 55*b*; that is, the end portion 57*b* extends into a slot 91 of the plunger 41. The advantage of two springs 55, 57 of similar wire gauge and elastic properties as compared with one spring of heavier wire gauge, is that two springs yield more readily to a given pressure on the push-button 13 than would one spring. On the other hand, both springs 55 and 57 when released hold the plunger 41 to the uppermost position and retain the plunger in that position in the presence of high vibrations which may occur near the switch 3. Moreover, the provision of two springs 55 and 57 of similar construction is less costly because it reduces the number of parts necessary for the assembly. Two springs 55, 57 instead of one spring cooperate to maintain the plunger 41 in the biased position.

Manifestly, when the push-button 13 is pressed, the plunger 41 moves the contacts 51 to the open position and the contacts 53 to the closed position with contacts 47, 49. Release of the push-button 13 returns the contacts 51 to closed positions with contacts 43, 51.

Interlock means for interconnecting adjacent blocks 7 and 9 against longitudinal separation include interengaging elongated hook-like members 93, one on each side of the blocks 7 and 9, which members have a latch surface 95 which engages or overlaps a corresponding latched surface 97 on a projection 98 the housing cover 59 of the contact block 9. Beveled or inclined edges 99, 101 on the member and the cover 59, respectively, facilitate assembly of the blocks 7 and 9 by sliding the beveled edges 99, 101 together and causing the members 93 to expand radially until the surfaces 95, 97 snap into engagement. Disengagement of the members 93 by manual means by the insertion of a tool such as a screwdriver between one beveled edge 99 and the outer surface 9a enables outward bending of the slightly elastic material forming the members 93 and thereby enables disengagement of the blocks 7 and 9.

In accordance with this invention the blocks 7 and 9 are also provided with interlock means for interconnecting adjacent blocks against transverse or rotational separation which means include projections or pins or dowels 103 and corresponding pin-receiving recesses 105. The pins 103 extend from the undersurface of the housing and are molded or integral therewith. The recesses or holes 105 are provided in the cover 59 of the housing and are aligned with the pins 103 of the adjacent block. Accordingly, when the blocks 7 and 9 are assembled in the manner shown in the drawings, the interengaging pins 103 and recesses 105 prevent rotation or twisting of the blocks 7 and 9 with respect to each other which would otherwise enable disengagement of the latch surfaces 95 and 97.

Finally, as shown in FIG. 2 in broken lines two series of blocks 107 and 109 may be assembled together to operate with the push-button operator 5 independently of each other and simultaneously.

In conclusion, the electric switch of this invention provides an assembly of contact blocks stacked in end-to-end relationship which blocks include not only interlock means for preventing longitudinal separation of the blocks but also with two interlock means for preventing the blocks from separating transversely.

What is claimed is:

1. An electric switch asembly comprising at least two contact blocks stacked in end-to-end surface abutment and on a longitudinal axis, each contact block having stationary and movable contacts, each block also having movable contact operating means including a guided reciprocable plunger, the plunger in each block being in end-to-end abutment with the plunger of an adjacent block, manual means adjacent to one block and operatively connected to the plunger thereof, interlock means interconnecting adjacent blocks against longitudinal movement and comprising elongated hook-like members on one block detachably engaged with projections on another adjacent block, each reciprocable plunger being biased in a desired position by a pair of springs operatively connected thereto, and each spring having one outturned end portion bearing against the block and having another outturned end portion bearing against the plunger.

* * * * *